US005478523A

United States Patent [19]

Brusso et al.

[11] Patent Number: 5,478,523

[45] Date of Patent: Dec. 26, 1995

[54] GRAPHITIC STEEL COMPOSITIONS

[75] Inventors: James A. Brusso; George T. Matthews, both of Stark County, Ohio

[73] Assignee: The Timken Company, Canton, Ohio

[21] Appl. No.: 185,692

[22] Filed: Jan. 24, 1994

[51] Int. Cl.[6] ..... C21D 8/10; C22C 38/02

[52] U.S. Cl. ..... 420/99; 420/100; 420/101; 148/593; 148/654; 148/320

[58] Field of Search ..... 148/593, 654, 148/320; 420/99–101

[56] References Cited

U.S. PATENT DOCUMENTS 3,099,556 7/1963 Jatczak ..... 420/99
4,061,494 12/1977 Yokokawa et al. .

FOREIGN PATENT DOCUMENTS 1238674 4/1967 Germany ..... 420/100
5315451 11/1972 Japan .
5346774 2/1973 Japan .
51-120919 4/1975 Japan .
2111842 12/1986 Japan .
4301030 3/1991 Japan .

*Primary Examiner*—Deborah Yee
*Attorney, Agent, or Firm*—Webb Ziesenheim Bruening et al.

[57] ABSTRACT

A machinable, graphitic steel is disclosed having a composition in weight % of about 1.0 to 1.5 total C; 1.0 to Si; 0.3 to 1.0 Mn; up to 2.0 Ni; up to 0.5 Cr; up to 0.5 Mo; up to 0.1 S; up to 0.5 Al; balance Fe and incidental impurities. The steel is hot worked and cooled to precipitate a controlled amount of graphite for improved machinability and to achieve a controlled amount of matrix carbon for enhanced physical properties. A matrix carbon content of between about 0.2 to 0.8 weight % is desired. The steel may be further heat treated to yield further variations in the microstructure and physical properties.

23 Claims, 11 Drawing Sheets

41L50
Q +T (300 BHN)

S38MS1V
As- forged (300 BHN)

Graphitic Alloy 671
As- forged (290 BHN)

GRAPHITIC STEEL COMPOSITIONS

Be it known that we, James A. Brusso, citizen of the United States and residing at 1957 Billman Street, N.E., Hartville, Ohio 44632; and George T. Matthews, citizen of the United States and residing at 13762 West Beech Street, N.E., Alliance, Ohio 44601, have invented new and useful improvements in GRAPHITIC STEEL COMPOSITIONS of which the following is a specification.

BACKGROUND OF THE INVENTION

The present invention relates generally to ferrous materials and, more particularly to graphitic steels which are highly machinable. Machining generally accounts for a significant cost of manufacturing with respect to articles produced from bar, billets, forgings, or mechanical tubing having substantial mechanical property and wear requirements. In this regard, it is not unusual for machining to amount to up to 50% of the manufacturing cost. Therefore, steels with improved machinability properties have been sought to reduce costs. Since the mechanical properties, and particularly the strengths, of these articles are quite demanding, such steels present difficulties when machining is conducted at the desired, usable strength levels. One method commonly used to improve the machinability of these steels is to perform a softening heat treatment prior to machining, and a further heat treatment following machining. Each heat treatment represents additional cost, thus placing a greater emphasis on reducing the energy costs associated with these multiple thermal treatments. One solution is to machine the articles at the required strength level for the application, such as, for example, by using microalloyed steels. This approach places a considerable demand on the machining operation to further highlight the continual need for improved machinability of these materials.

There are currently several methods used to improve the machinability of these materials, but each has one or more notable shortcomings.

It is known to improve the machinability of steels by introducing various additives such as sulfur (S), lead (Pb), bismuth (Bi), tellurium (Te), and selenium (Se). Heretofore, sulfur has been the most widely used additive for its ability to form manganese sulfide (MnS) inclusions which can act as both a lubricant at the tool interface and as a stress riser for enhancing chip breakage to improve chip disposability. The maximum achievable effect of S on machinability of steels is limited, however, because of the detrimental effect of MnS inclusions on the mechanical properties of the material.

Te and Se can improve the machinability of steels by globurizing the manganese sulfides and forming additional "sulfide-like" inclusions. However, at the Te and Se levels required for improved machinability, these steels suffer from poor hot working characteristics and are susceptible to "hot shortness" problems, i.e., brittle behavior at hot working temperatures. The major advantage of these additives is to improve transverse properties, thereby allowing higher sulfur contents for some improved machinability.

Pb provides several advantages as an additive for improving the machinability of steels. Pb can greatly improve tool life by acting as a lubricant between the cutting tool and workpiece because of its low melting temperature. Pb may also act as a stress riser and/or liquid metal embrittlement agent to improve chip disposability. At levels where Pb is effective in improving machinability, it can have very little effect on mechanical properties. In addition, Pb is much more effective in improving machinability than S, Te, or Se. However, Pb is not environmentally friendly and there is, and will continue to be, increasing pressure placed on steel producers to develop alternatives to Pb-containing steels.

Bismuth (Bi) is chemically similar to Pb and acts in much the same way as Pb in improving machinability. Although the environmental effects of Bi have not been fully investigated and understood, the processing precautions when alloying with Bi are similar to those for Pb. In addition, the high costs of Bi may not provide an economically feasible alternative to Pb.

Additional attempts to improve the machinability of steels have focused on the development of graphitic steels. Early graphitic steels were largely tool steels in which graphitization was achieved through heat treatment. The major purpose of the graphite was to enhance the lubricating properties of the steel, for example, to improve die life, although machinability improvements were also realized. These steels were designed with limited graphitization in order to maintain the necessary heat treatment response during hardening.

More recent developments with graphitic steels have required extensive graphitization to realize machinability comparable to free machining steels. These steels require relatively long graphitizing heat treatments with the goal of achieving a ferrite and graphite microstructure in which all of the carbon in the alloy is precipitated as graphite. Although machinability improvements can be realized with these steels, the graphitic steel in this condition has inadequate mechanical properties for most structural applications unless subjected to additional hardening treatments following machining. The costly and time consuming heat treatments make these graphitic steels less attractive for articles such as crankshafts, ring gears, and other such components.

As mechanical property requirements increase and the size of components decrease (power density) for many of these structural applications, cast iron is being replaced by wrought steel. A major drawback of cast iron is the inability to improve the mechanical properties through hot working because of the inherent brittleness and lack of hot ductility. Microalloyed steels have received the greatest consideration because they achieve the required mechanical properties directly upon cooling from the hot working temperature without the need for additional heat treatments following machining. A difficulty with the microalloyed steels is that they generally do not provide the chip control available with cast irons, particularly in deep-hole drilling. High S contents and/or Pb provide improvements to the machinability of the microalloys, but also are associated with the problems outlined previously. The graphitic steels of the present invention provide a means to overcome many of the above shortcomings.

SUMMARY OF THE INVENTION

The present invention is directed to graphitic steels which graphitize upon controlled cooling from the hot working temperature to achieve the desired core hardness through composition and thermal-mechanical processing, a characteristic shared with microalloyed (non-graphitic) steels. The graphitic steel of the invention may be further heat treated to provide various strength levels and/or matrix carbon contents, each containing different graphite contents and/or distributions. The present steel can also be hardened using traditional quench and temper techniques to provide a graphite dispersion within a tempered martensitic structure. By controlling the matrix carbon content, the steel of the instant invention can also be induction hardened. The machinability, in terms of tool life and chip disposability, of the graphitic steel of the present invention can equal or exceed that of leaded and bismuth-containing steels and cast irons at equivalent strength levels.

Briefly stated, the composition of the graphitic steel alloy of the present invention consists essentially of, in weight %, about: 1.0 to 1.5 total C; 0.7 to 2.5 Si; 0.3 to 1.0 Mn; up to 2.0 Ni; up to 0.5 Cr; up to 0.5 Mo; up to 0.1 S; up to 0.5 Al and the balance Fe and incidental impurities. In addition, Ca and Mg may be added separately or in combination, up to 0.01 weight %; rare earth metals (REM) up to 0.100 weight % total; and B up to 0.0050 weight %. The steel preferably has a controlled matrix carbon content in the range of about 0.2 to 0.8 weight % and wherein about 0.3 to 1.3 weight % of the total carbon content is in the form of graphite. The unique aspects of the present invention reside in the fact that the matrix carbon content and strength levels are controlled by alloy chemistry and by thermal-mechanical processing, and a heat treatment following machining is eliminated.

More preferably, the alloy composition of the invention consists essentially of, in weight % about: 1.15 to 1.35 total C; 1.50 to 2.0 Si; 0.35 to 0.70 Mn; less than 0.06 S; 0.02 to 0.20 Al; less than 0.1 for each of Cr and Mo; less than 0.50 Ni; and the balance Fe and incidental impurities. Additions of Ca, Mg, REM and B may also be made as specified above.

The graphitic steel of the invention is hot worked in the range of approximately 1050°–1150° C. by, for example, rolling, piercing or forging, followed by air or controlled cooling to provide a desired degree of graphitization/matrix carbon and mechanical properties. The shapes can be further hot worked to a desired configuration and subsequently cooled and/or further heat treated to yield a desired microstructure and mechanical properties. One presently preferred microstructure comprises ferrite, pearlite and graphite, with a matrix carbon content generally not exceeding the eutectoid carbon content.

BRIEF DESCRIPTION OF THE DRAWINGS

FIG. 11 (*b*) is a photomicrograph of the same forged crankshaft as depicted in FIG. 11 (*a*) but subjected to further heat treatment resulting in a hardness of 290 BHN.

DETAILED DESCRIPTION OF THE INVENTION

Figure 1:
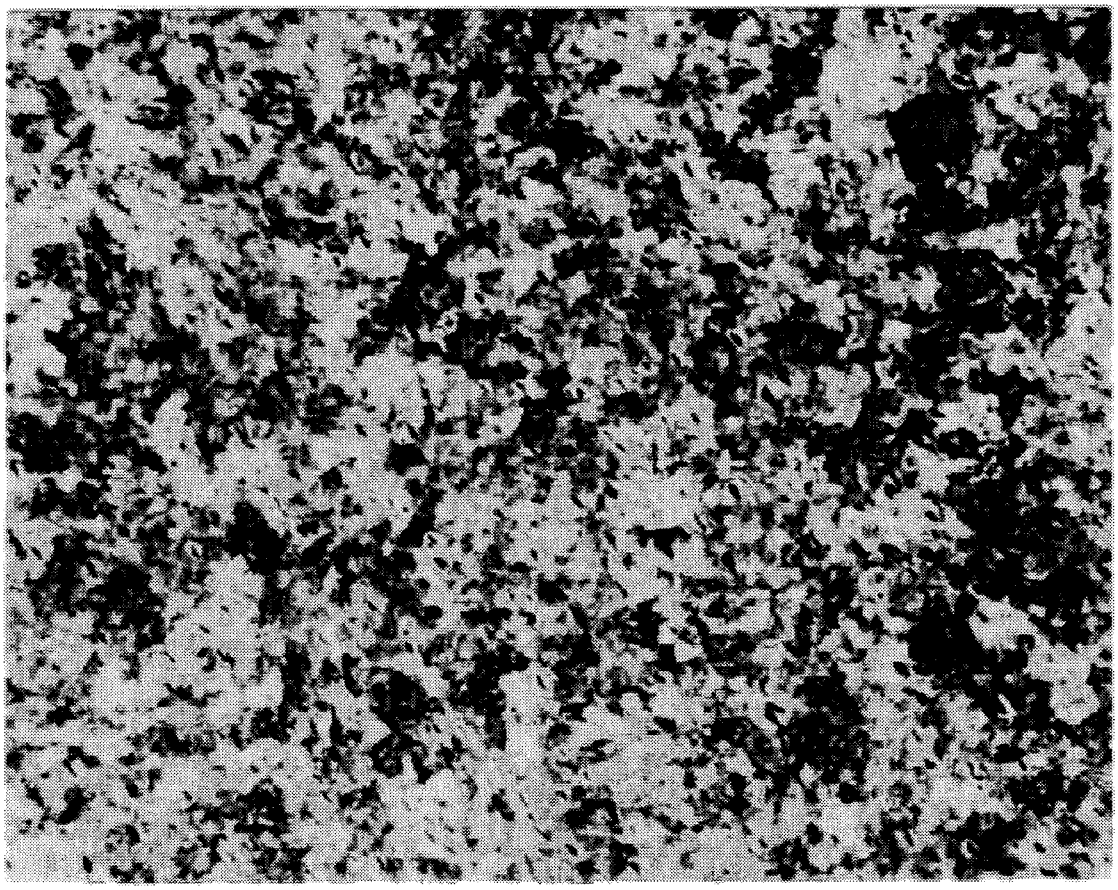
FIG. 1 is a photomicrograph at 100× magnification of graphitic Alloy 671 (Table I) of the invention in an as-forged and air cooled condition at a hardness of 290 BHN (Brinell Hardness Number)

The steels are melted using practices that are conventional for producing graphitic steels. The preferred method is to melt the steel in an electric furnace using standard practices for killed steels. Although calcium, magnesium and rare earth metals (REM) are not required for the invention, these elements may be used to enhance graphitization. Ingots may be placed directly in soaking pits held at the rolling temperature or be allowed to cool slowly in the molds or soaking pits to ambient temperature. It is preferable that the cold ingots be placed in cold soaking pits (250 ° C.) and heated slowly at a heating rate of approximately 35° C. per hour until at least 650° C. to reduce the occurrence of "sprung steel", or stress-induced cracking, common to as-cast high carbon steels. Continuously cast blooms may be direct charged into a reheat furnace or slow cooled to ambient temperature and preferably reheated in a manner similar to the ingots.

The steel is rolled or forged at approximately 1050°–1150° C. and the optimum hot working temperature depends largely on the chemistry. Although the material may be either furnace heated or induction heated, soaking time at temperature must be sufficient to resolutionize the graphitic carbon present from the previous hot working operation. In addition, care must be exercised not to overheat or "burn" the steel, or hot workability will be severely reduced. The preferred hot working finishing temperature is above 850° C. The billets or bars can be air cooled or control cooled to provide the desired matrix carbon content and mechanical properties based on the chemistry, or can be further processed into articles such as seamless tubing and forged components. The hot working temperature must be selected within the approximate range outlined above in order to provide optimum hot ductility. Again, the articles may be air cooled or control cooled to yield the desired microstructures and mechanical properties. Further, the articles may be heat treated to broaden the achievable structures/properties for additional applications.

A series of alloys (Table I) were melted and hot worked by rolling, piercing, and/or forging and examined for graphitic carbon. Through the control of chemistry and processing within the scope of this invention, graphite formation occurs upon cooling from the hot working temperature. The degree of graphitization and associated matrix carbon content and mechanical properties are controlled further through thermal-mechanical processing. A unique feature of this invention resides in the ability to produce a wrought version of cast iron or cast steel of the indicated composition, while achieving the desired mechanical properties without the need for additional hardening treatments following machining.

The matrix carbon contents are controlled by alloy chemistry and thermal-mechanical processing. The matrix carbon is defined as the non-graphite carbon remaining in the alloy after graphitization which directly contributes to the presence of pearlite in the microstructure and permits higher hardness levels.

A unique aspect of this invention is that the matrix carbon content and strength levels are controlled through adjustments in thermal-mechanical processing and alloy chemistry. The amount of graphite (weight % C) that is precipitated to inversely achieve a particular matrix carbon content is, therefore, fixed. For example, an alloy containing 1.25 weight % C can achieve a matrix carbon content of 0.5 weight % only if 0.75 weight % C is in the form of graphite. It can also achieve a matrix carbon content of 0.2 weight % C only if 1.05 weight % C is precipitated as graphite. In the invention, it is possible to achieve matrix carbon contents in the range of nearly zero carbon and up to 0.8 weight % carbon or higher. Primary applications of interest require matrix carbon contents in the range of 0.2–0.8 weight %. In addition to controlling the matrix carbon content, the invention also provides a process through chemistry control and processing steps to achieve a range of strength levels at a given matrix carbon content. Taking the example above, with a matrix carbon content of 0.5 weight %, the hardness can be controlled over the approximate range of 250–350 BHN by controlling the chemistry. Additional control of the graphite distribution can be achieved through various known thermal-mechanical processing steps.

The resulting steels can be induction hardened in localized areas in a manner similar to conventional steels, and the graphite provides improvements in machinability over conventional steels and ductile cast iron at equivalent strength levels.

The broad composition of the graphitic alloy of the present invention consists essentially of: C in the range of 1.0 to 1.5 weight %; Si in the range of 0.7 to 2.5 weight %; Mn in the range of 0.3 to 1.0 weight %; Ni up to 2.0 weight %; Cr up to 0.5 weight %; Mo up to 0.5 weight %; S up to 0.1 weight % and Al up to approximately 0.5 weight %. The roles assumed by the various alloying elements are as follows:

C: 1.0 to 1.5 weight %.

Carbon is necessary for graphitization and to provide strength to the matrix. In quantities less than 1.0%, graphitization is significantly suppressed on cooling following hot working. At carbon contents greater than 1.5%, hot ductility is severely decreased because of the range of hot working temperatures becomes very restricted. The carbon equivalent (CE=%C+⅓ %Si) should be maintained in the range of approximately 1.75 to 2.1 to maintain hot workability and achieve adequate graphitization.

Si: 0.7 to 2.5 weight %.

Silicon is a very strong graphitizing agent and is necessary to promote graphite formation. In addition, Si is effective in increasing the strength of the ferrite and the hardenability of the steel. The Si content must be balanced with the carbon content to provide adequate hot ductility and graphitization. A silicon content below 0.7% does not achieve the necessary carbon equivalent in the formula set forth above.

Mn: 0.3 to 1.0 weight %.

Manganese is essential and must be balanced with sulfur to form MnS and prevent the formation of FeS which results in hot shortness in steels. Mn promotes the formation of cementite and should not exceed that amount required to combine with the sulfur. Excess manganese inhibits graphitization and should be added for hardenability only with caution.

S: up to 0.1 weight %.

Sulfur combines with Mn to form MnS inclusions which improve machinability, but at the expense of mechanical properties. Therefore, the sulfur content must be balanced with Mn for the application. Excess sulfur also inhibits graphitization and should only be added when the machinability improvement from additional MnS exceeds the machinability loss from reduced graphite.

Al: up to 0.5 weight %.

Aluminum is a strong graphitizing agent and promotes the formation of spheroidal graphite. The effect of Al on graphitization saturates at higher Al levels.

Ni: up to 2.0 weight %.

Nickel enhances graphitization and hardenability but should be added only to achieve the desired hardenability and strength levels.

Cr, Mo: each up to 0.5 weight %.

Chromium and molybdenum are strong carbide forming elements and reduce the tendency for graphite formation. These elements should be added only to achieve the desired hardenability and strength levels. In addition to the elements listed above, the following may be added if desired:

Ca, Mg: each up to 0.01 weight %.

Calcium and magnesium promote the formation of graphite in steel and can be added separately or in combination.

REM: up to 0.100 weight % total.

Rare earth metals (REM) promote the formation of graphite in steels and it is preferable to add REM as mischmetal.

B: up to 0.0050 weight %.

Boron combines with nitrogen to reduce the free nitrogen in the steel, promoting graphitization.

TABLE I

| Alloy | C | Mn | P | S | Si | Cr | Ni | Mo | Cu | Al | B | V | Ti | Ca | Mg | REM | N (wppm) |
|---|---|---|---|---|---|---|---|---|---|---|---|---|---|---|---|---|---|
| 602 | 0.77 | 0.89 | 0.012 | 0.015 | 0.66 | 0.24 | 0.21 | 0.01 | 0.01 | 0.187 | — | — | — | — | — | — | 85 |
| 603 | 0.78 | 0.92 | 0.012 | 0.015 | 0.96 | 0.01 | 0.02 | 0.01 | 0.01 | 0.201 | — | — | — | — | — | — | 75 |
| 604 | 0.99 | 0.92 | 0.012 | 0.014 | 0.68 | 0.01 | 0.01 | 0.01 | 0.01 | 0.196 | — | — | — | — | — | — | 77 |
| 605 | 0.97 | 0.91 | 0.013 | 0.015 | 0.97 | 0.01 | 0.01 | 0.01 | 0.01 | 0.134 | — | — | — | — | — | — | 68 |
| 606 | 0.97 | 0.91 | 0.013 | 0.016 | 0.97 | 0.01 | 0.01 | 0.01 | 0.01 | 0.209 | — | — | — | — | — | — | 75 |
| 627 | 1.10 | 0.91 | 0.013 | 0.012 | 1.03 | 0.01 | 0.01 | 0.01 | 0.01 | 0.134 | — | — | — | — | — | — | 69 |
| 628 | 1.23 | 0.91 | 0.015 | 0.011 | 1.02 | 0.01 | 0.01 | 0.01 | 0.01 | 0.132 | — | — | — | — | — | — | 74 |
| 629 | 1.40 | 0.92 | 0.014 | 0.012 | 0.71 | 0.01 | 0.01 | 0.01 | 0.01 | 0.128 | — | — | — | — | — | — | 78 |
| 630 | 1.41 | 0.91 | 0.014 | 0.011 | 1.27 | 0.01 | 0.01 | 0.01 | 0.01 | 0.133 | — | — | — | — | — | — | 74 |
| 631 | 1.25 | 0.90 | 0.014 | 0.012 | 1.50 | 0.01 | 0.01 | 0.01 | 0.01 | 0.135 | — | — | — | — | — | — | 74 |

TABLE I-continued

| Alloy | C | Mn | P | S | Si | Cr | Ni | Mo | Cu | Al | B | V | Ti | Ca | Mg | REM | N (wppm) |
|---|---|---|---|---|---|---|---|---|---|---|---|---|---|---|---|---|---|
| 632 | 1.24 | 0.90 | 0.014 | 0.011 | 2.00 | 0.01 | 0.01 | 0.01 | 0.01 | 0.140 | — | — | — | — | — | — | 67 |
| 671 | 1.22 | 0.90 | 0.010 | 0.010 | 2.00 | 0.02 | 0.01 | 0.01 | 0.01 | 0.150 | — | — | — | — | .0023 | — | 74 |
| 672 | 1.20 | 0.90 | 0.010 | 0.010 | 2.00 | 0.01 | 0.02 | 0.08 | 0.01 | 0.150 | — | — | — | .0013 | — | — | 76 |
| 687 | 1.21 | 0.87 | 0.015 | 0.012 | 1.84 | 0.01 | 0.01 | 0.01 | 0.01 | 0.135 | — | — | — | .0009 | .0020 | — | 72 |
| 688 | 1.25 | 0.90 | 0.015 | 0.011 | 1.46 | 0.01 | 0.01 | 0.01 | 0.01 | 0.141 | — | — | — | .0005 | .0018 | — | 76 |
| 689 | 1.25 | 0.91 | 0.015 | 0.010 | 0.96 | 0.01 | 0.01 | 0.01 | 0.01 | 0.138 | — | — | — | .0004 | .0020 | — | 79 |
| 690 | 1.04 | 0.89 | 0.015 | 0.011 | 1.88 | 0.01 | 0.01 | 0.01 | 0.01 | 0.143 | — | — | — | .0007 | .0021 | — | 77 |
| 712 | 1.20 | 0.90 | 0.015 | 0.057 | 2.01 | 0.07 | 0.01 | 0.02 | 0.01 | 0.152 | — | — | — | .0018 | — | — | 90 |
| 713 | 1.22 | 0.90 | 0.014 | 0.057 | 2.05 | 0.02 | 0.01 | 0.02 | 0.01 | 0.144 | — | — | — | .0009 | — | — | 88 |
| 722 | 1.13 | 0.94 | 0.012 | 0.058 | 2.10 | 0.08 | 0.01 | 0.06 | 0.01 | 0.038 | — | — | — | .0015 | — | — | 66 |
| 723 | 1.37 | 0.38 | 0.011 | 0.045 | 0.69 | 0.15 | 0.20 | 0.24 | 0.01 | 0.007 | — | — | — | .0025 | — | — | 90 |
| 724 | 1.10 | 0.62 | 0.012 | 0.052 | 1.65 | 0.26 | 0.24 | 0.25 | 0.01 | 0.023 | — | — | — | .0034 | — | — | 81 |
| 732 | 1.17 | 0.88 | 0.014 | 0.022 | 1.99 | 0.01 | 0.01 | 0.01 | 0.01 | 0.172 | — | — | — | — | — | 0.047 | 94 |
| 742 | 1.26 | 0.93 | 0.012 | 0.043 | 2.04 | 0.01 | 0.01 | 0.01 | 0.01 | 0.156 | — | — | — | — | .0018 | — | 92 |
| 743 | 1.26 | 0.92 | 0.012 | 0.043 | 2.03 | 0.03 | 0.01 | 0.01 | 0.01 | 0.165 | — | — | — | — | .0022 | — | 113 |
| 744 | 1.26 | 0.92 | 0.012 | 0.045 | 1.99 | 0.12 | 0.01 | 0.01 | 0.01 | 0.142 | — | — | — | — | .0018 | — | 100 |
| 765 | 1.10 | 1.00 | 0.017 | 0.042 | 2.17 | 0.50 | 0.18 | 0.17 | 0.01 | 0.158 | — | — | — | .0005 | — | — | 86 |
| 766 | 1.13 | 0.99 | 0.016 | 0.034 | 2.22 | 0.22 | 0.19 | 0.17 | 0.01 | 0.163 | — | — | — | .0034 | — | — | 92 |
| 767 | 1.13 | 0.96 | 0.016 | 0.044 | 2.09 | 0.18 | 0.18 | 0.17 | 0.01 | 0.146 | — | — | — | .0008 | — | — | 93 |
| 768 | 1.14 | 0.98 | 0.016 | 0.041 | 2.05 | 0.23 | 0.19 | 0.17 | 0.01 | 0.154 | — | — | — | .0013 | — | 0.059 | 108 |
| 812 | 1.23 | 0.70 | 0.018 | 0.043 | 1.83 | 0.16 | 0.39 | 0.16 | 0.01 | 0.143 | — | — | — | .0033 | — | — | 102 |
| 813 | 1.22 | 0.69 | 0.012 | 0.042 | 1.56 | 0.17 | 0.43 | 0.16 | 0.01 | 0.127 | — | .102 | — | .0033 | — | — | 95 |
| 814 | 1.22 | 0.70 | 0.014 | 0.039 | 1.66 | 0.17 | 0.46 | 0.16 | 0.01 | 0.137 | .0018 | — | .020 | .0039 | — | — | 94 |
| 815 | 1.24 | 0.68 | 0.018 | 0.044 | 1.60 | 0.16 | 0.43 | 0.16 | 0.01 | 0.036 | — | — | — | .0038 | — | — | 91 |
| 816 | 1.25 | 0.69 | 0.016 | 0.042 | 1.61 | 0.16 | 0.42 | 0.16 | 0.01 | 0.028 | — | .098 | — | .0031 | — | — | 102 |
| 817 | 1.22 | 0.68 | 0.014 | 0.037 | 1.55 | 0.17 | 0.46 | 0.16 | 0.01 | 0.031 | .0014 | — | .020 | .0036 | — | — | 100 |
| 851 | 1.02 | 0.63 | 0.012 | 0.047 | 1.78 | 0.21 | 0.35 | 0.13 | 0.01 | 0.138 | — | — | — | .0026 | — | — | 80 |
| 852 | 1.25 | 0.69 | 0.013 | 0.051 | 1.92 | 0.16 | 0.41 | 0.15 | 0.01 | 0.154 | — | .100 | — | .0028 | — | — | 87 |
| 853 | 1.18 | 0.70 | 0.013 | 0.048 | 1.94 | 0.16 | 0.41 | 0.15 | 0.01 | 0.150 | .0022 | — | — | .0030 | — | — | 90 |
| 854 | 1.21 | 0.69 | 0.013 | 0.048 | 1.92 | 0.17 | 0.42 | 0.15 | 0.01 | 0.035 | — | — | — | .0029 | — | — | 94 |
| 855 | 1.23 | 0.70 | 0.014 | 0.047 | 1.92 | 0.17 | 0.41 | 0.16 | 0.01 | 0.043 | — | .099 | — | .0029 | — | — | 89 |
| 856 | 1.24 | 0.67 | 0.013 | 0.045 | 1.91 | 0.17 | 0.43 | 0.15 | 0.01 | 0.038 | .0015 | — | — | .0034 | — | — | 89 |
| 27834 | 1.12 | 0.93 | 0.009 | 0.047 | 2.15 | 0.15 | 0.10 | 0.14 | 0.15 | 0.152 | — | — | — | .0004 | — | — | 68 |
| 92654 | 1.26 | 0.82 | 0.015 | 0.043 | 2.08 | 0.14 | 0.40 | 0.15 | 0.16 | 0.156 | — | — | — | .0009 | — | — | 61 |

Specific graphitic steel alloys made according to the present invention are set forth in the following examples:

EXAMPLE I

Figure 2:
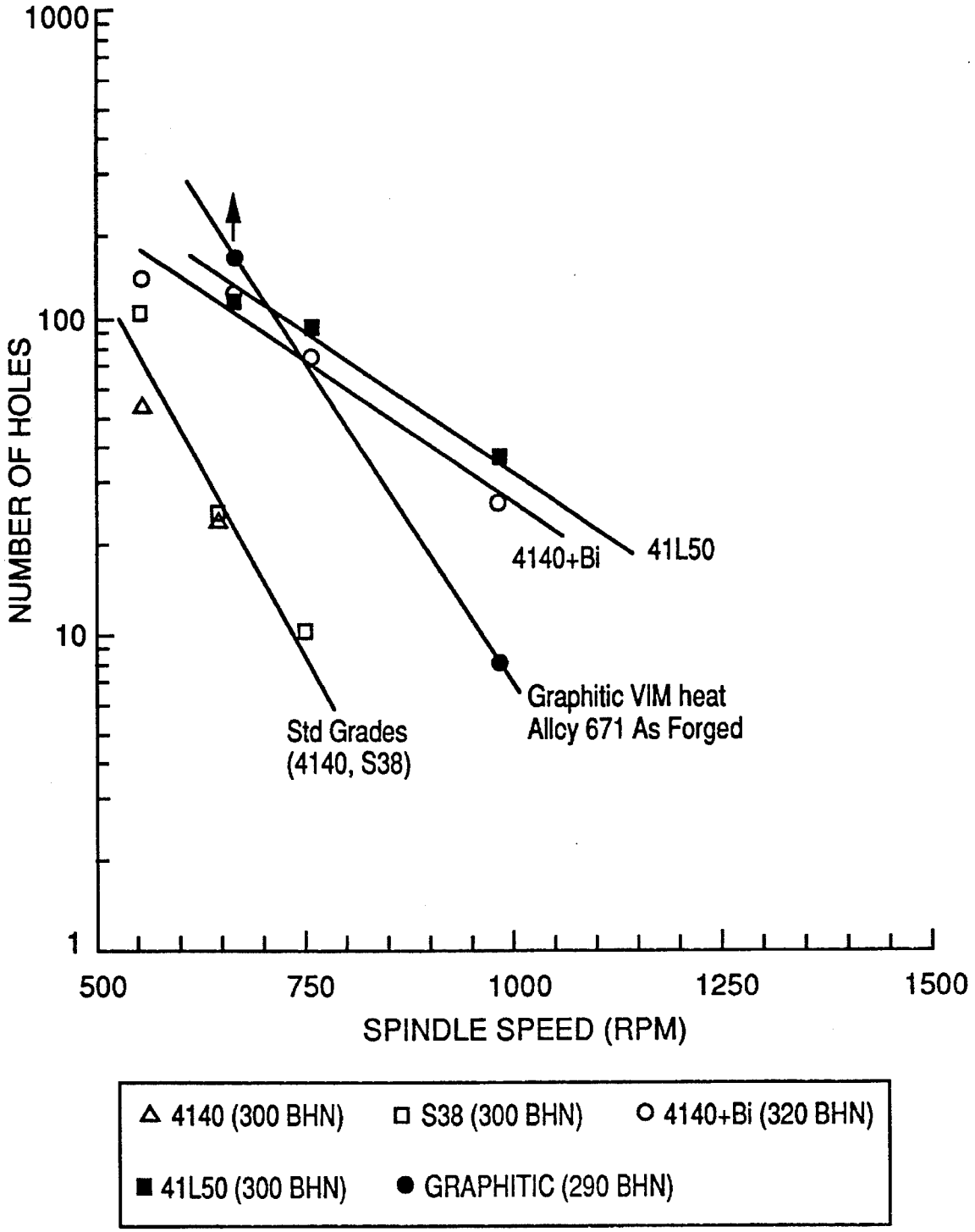
FIG. 2 is a graphic representation of drilling tests conducted on graphitic Alloy 671 comparing its performance with conventional steels, leaded steels and bismuth-containing steels.
Figure 3A:
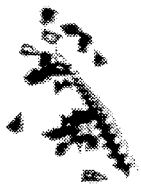
FIG. 3 is a photographic comparison of drilling chips collected after drilling graphitic Alloy 671, along with 41L50 and S38MS1V conventional alloys.
Figure 3B:
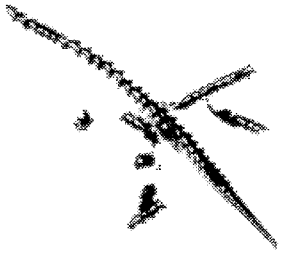
Figure 3C:
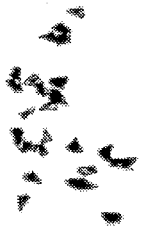

Alloy 671 (Table I) represents a 45 kg vacuum induction melted (VIM) laboratory heat. An approximately 130 mm diameter ingot was forged at 1121° C. to a reduction of 4:1 and still-air cooled. The as-forged hardness is 290 BHN (Brinell Hardness Number). The microstructure as shown in FIG. 1 consists of graphite, ferrite, and pearlite. The amount of carbon as graphite is approximately 0.67 weight % and the matrix carbon content is approximately 0.55 weight % C. Drilling tests were conducted on this alloy and the results are given in FIG. 2 along with results for conventional steels (4140 and S38MS1V), leaded steels (41L50) and bismuth-containing steels (4140+Bi) at equivalent strength levels. It is evident from FIG. 2 that the graphitic steel of the invention provides improved drill life over conventional steels, and that its drill life is comparable to leaded steels and bismuth-containing steels under certain drilling conditions. In addition, metal chips generated during machining, shown in FIG. 3, indicate that the graphitic steel of the invention provides excellent chip control during drilling operations.

Figure 4:
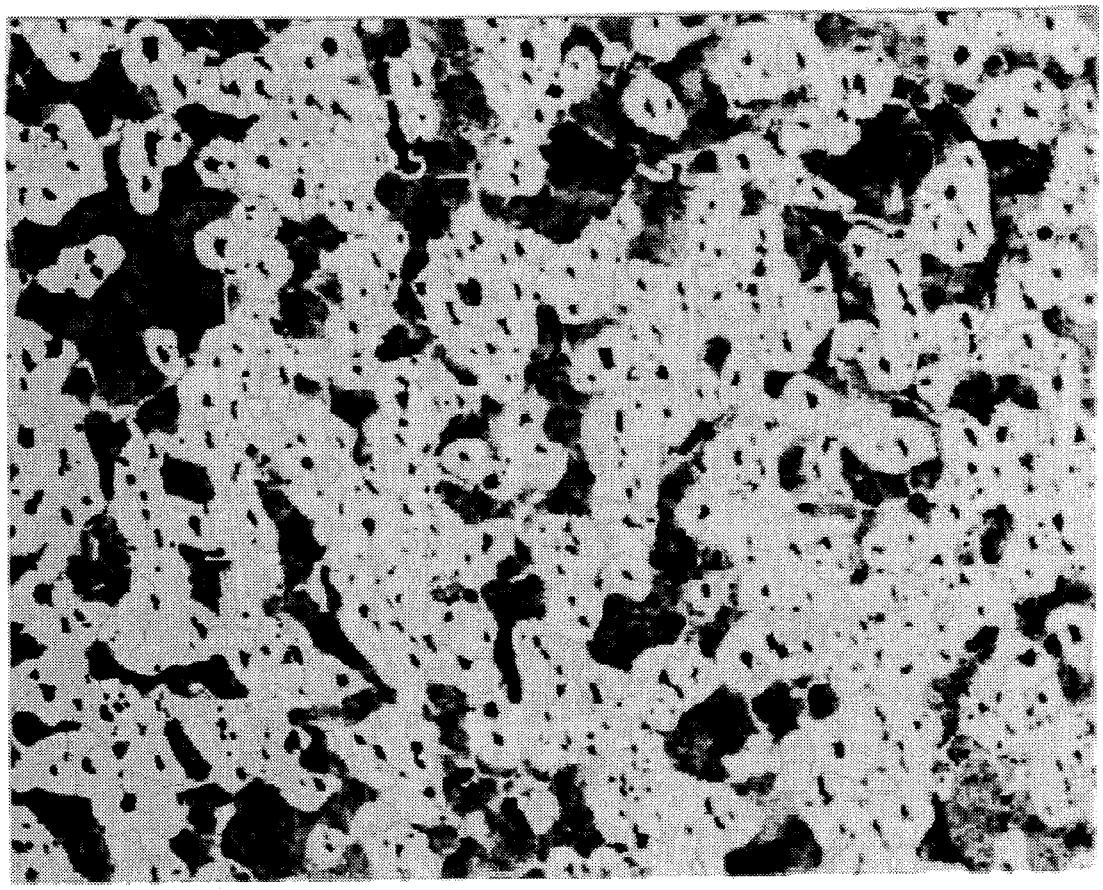
FIG. 4 is a photomicrograph of graphitic Alloy (Table I) at 100× magnification, following heat treatment to a hardness of 170 BHN.

The structure and properties of the graphitic steel alloys may be further modified by various thermal treatments to achieve a wide range of core mechanical properties. For example, FIG. 4 shows a microstructure consisting of ferrite, pearlite and graphite for the same alloy, Alloy 671, at a hardness of 170 BHN after subjecting the forged material to an additional thermal treatment, comprising the steps of heating for one hour at 1010° C. to resolutionize the graphitic carbon, cooling to 788° C. at a rate of 93° C. per hour to nucleate additional graphite, holding at 788° C. for two hours to allow the graphite to grow, cooling at 38° C. per hour to 650° C. and subsequent air cooling to control the matrix carbon content and fineness of the pearlite. The resulting microstructure consists of approximately 70 volume % ferrite, with approximately 1.0 weight % carbon in the form of graphite.

EXAMPLE II

Figure 5:
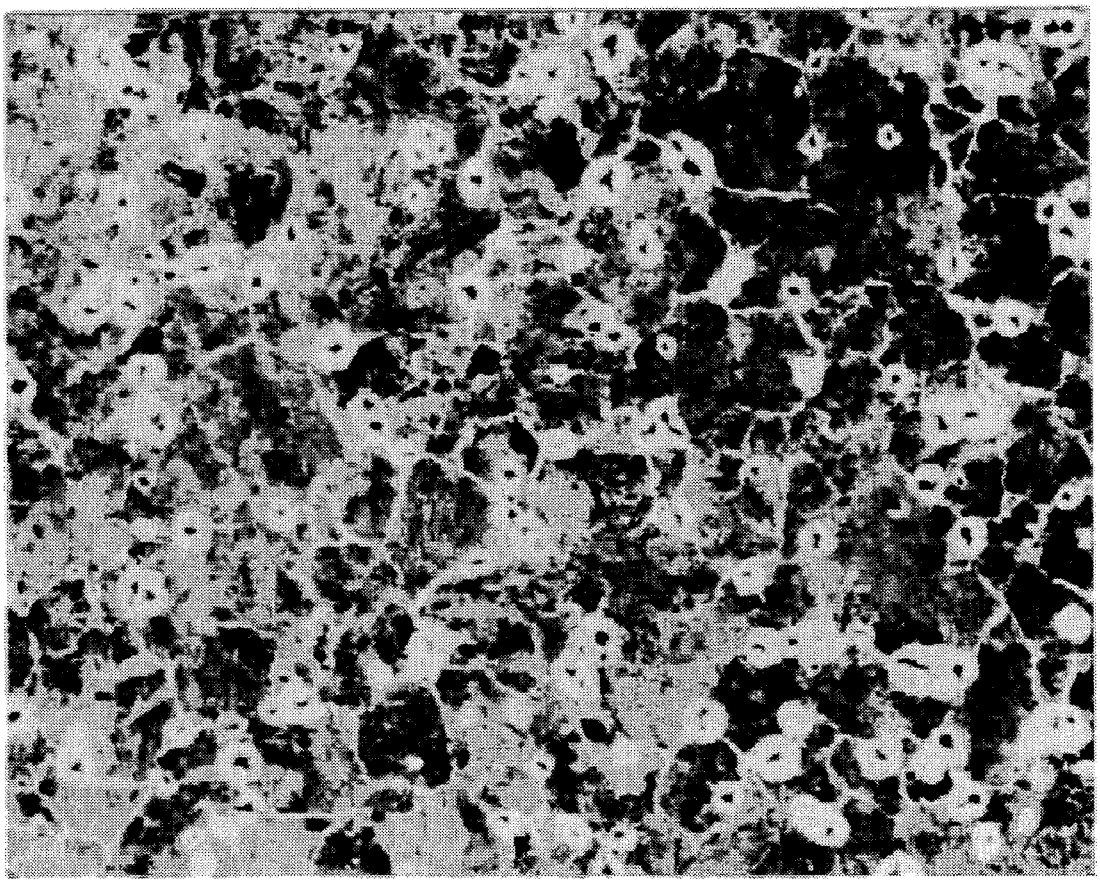
FIG. 5 is a photomicrograph of graphitic Alloy at 100× magnification hot worked by forging at 1121° C., air cooled and heat treated to a hardness of 200 BHN.

Alloy 632 (Table I) was processed as a 45 kg VIM laboratory heat. The approximately 130 mm diameter ingot was forged at 1121° C. to a reduction of 4:1 and subsequently still-air cooled. After forging, the alloy was given the following thermal treatment (same as in Example 1): one hour at 1010° C., cooled to 788° C. at 93° C. per hour, held at 788° C. for two hours, cooled at 38° C. per hour to 650° C. and air cooled. The resulting microstructure is shown in FIG. 5, and exhibited a hardness of approximately 200 BHN. The microstructure consists of grain boundary ferrite, ferrite surrounding graphite nodules, and pearlite. The amount of ferrite is approximately 15 volume % with approximately 0.75 weight % carbon in the form of graphite, and a matrix carbon content of approximately 0.5 weight %.

Figure 6:
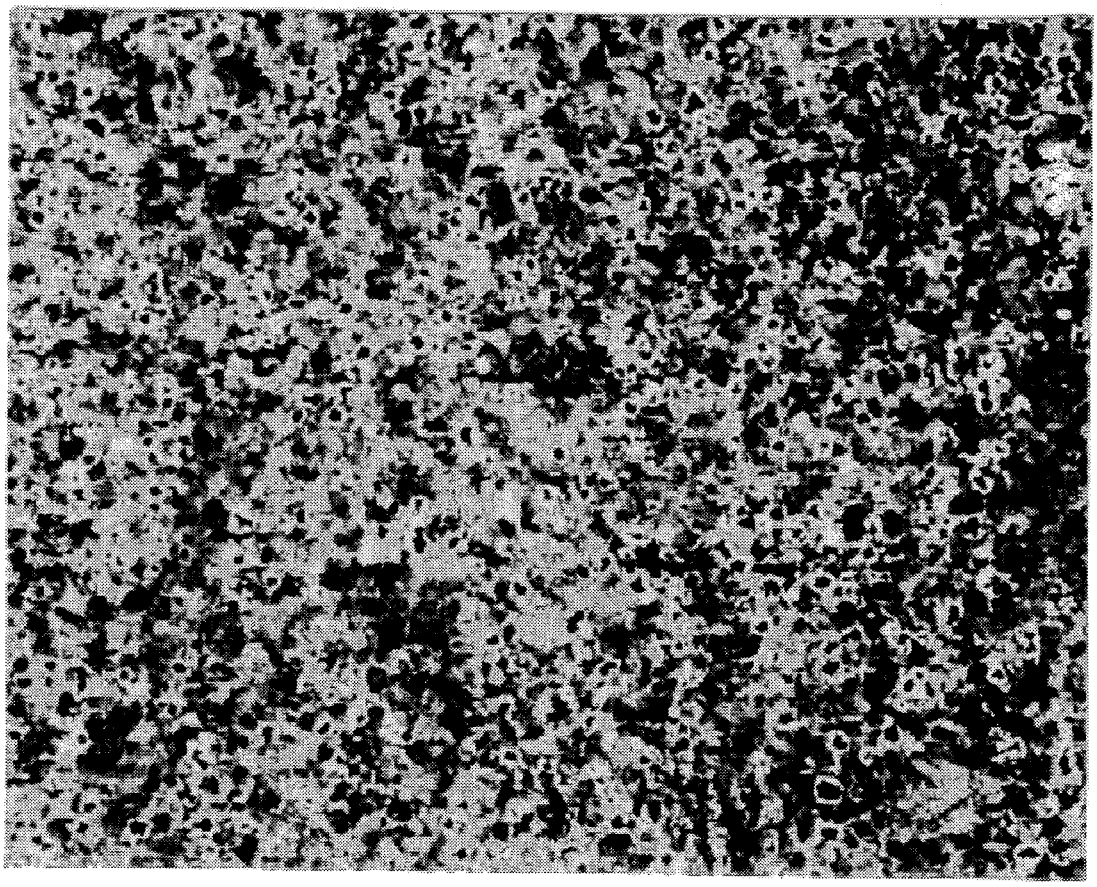
FIG. 6 is a photomicrograph of Alloy 632 of FIG. 7 also at 100× magnification, but given an alternate thermal treatment after forging to yield a finer structure, graphite distribution and a hardness of 280 BHN.
Figure 7:
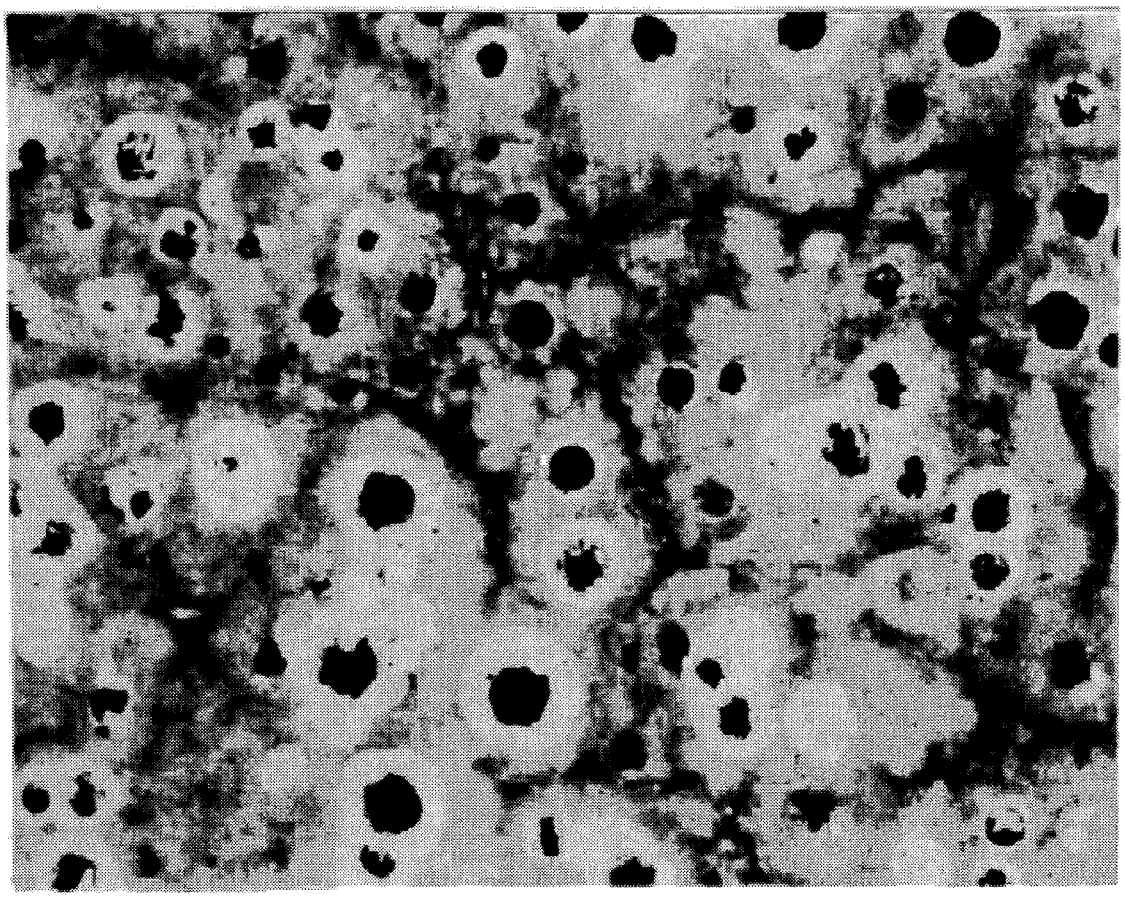
FIG. 7 is a photomicrograph of a typical ductile cast iron material used for crankshafts at 100× magnification, at a hardness of 245 BHN.

An alternative thermal treatment following forging of Alloy 632 involved heating the forging to 788° C. and holding the piece for two hours to transform the structure to austenite and graphite. This was followed by an air cool to ambient temperature. A much finer ferrite plus pearlite structure and graphite distribution resulted, as observed in FIG. 6. The hardness is 280 BHN. The scale of the microstructure can be compared with that of a typical ductile cast iron used for crankshafts, shown in FIG. 7, also at 100× magnification, at a hardness of 245 BHN.

Alloy 632 was also oil quenched following a two hour hold at 788° C., yielding a martensite and graphite microstructure which can be tempered to the desired strength level.

EXAMPLE III

Figure 8:
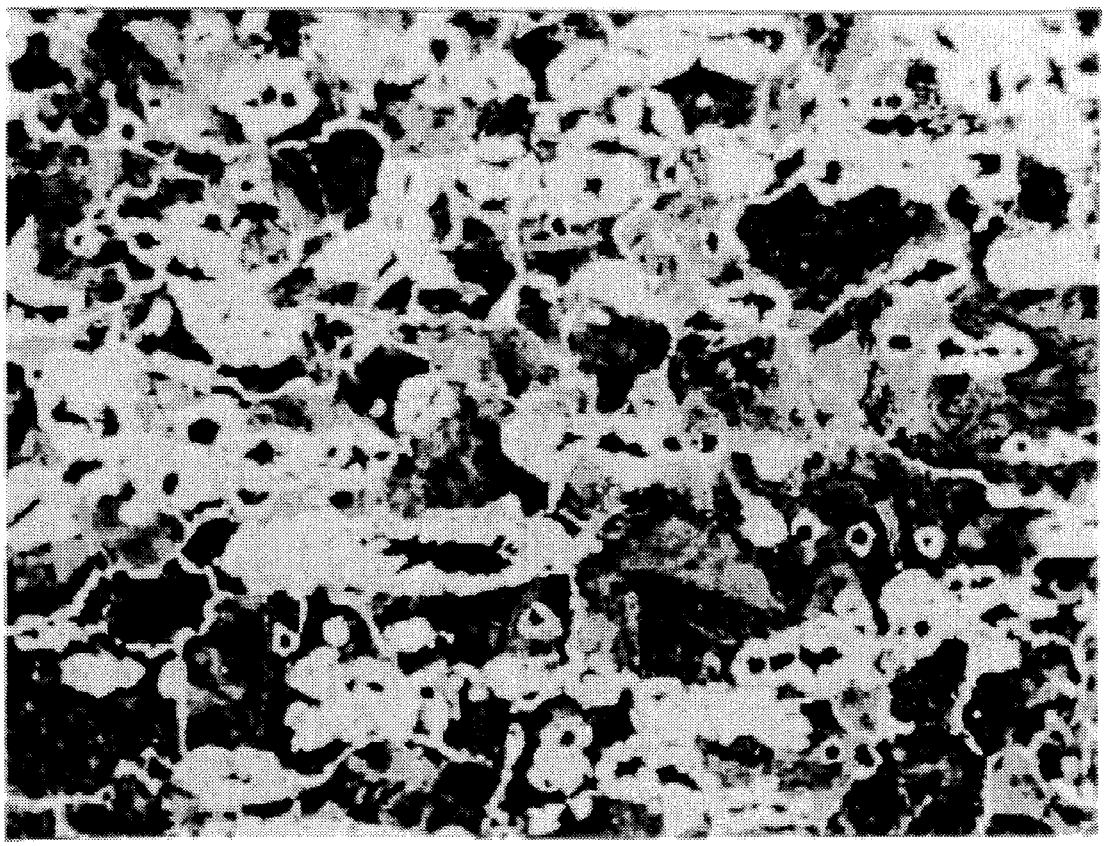
FIG. 8 is a photomicrograph of graphitic Alloy (Table I) at 100× magnification cast, hot rolled, cooled, reheated and rolled at 1121° C., heat treated to a hardness of 260 BHN.
Figure 9:
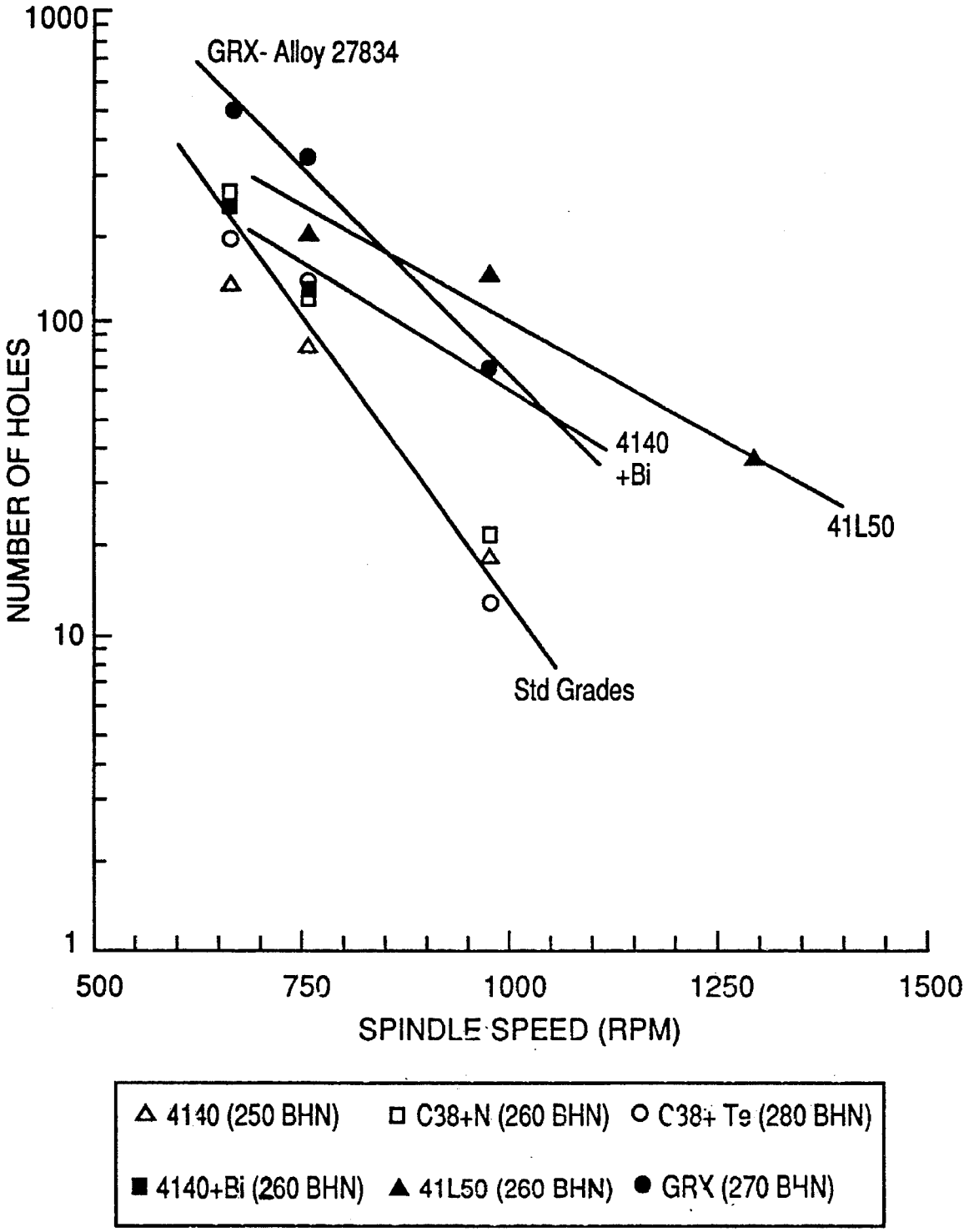
FIG. 9 is a graphic representation of drilling tests similar to FIG. 2 but comparing graphitic Alloy 27834 with conventional steels, leaded steels and bismuth-containing steels.
Figure 10:
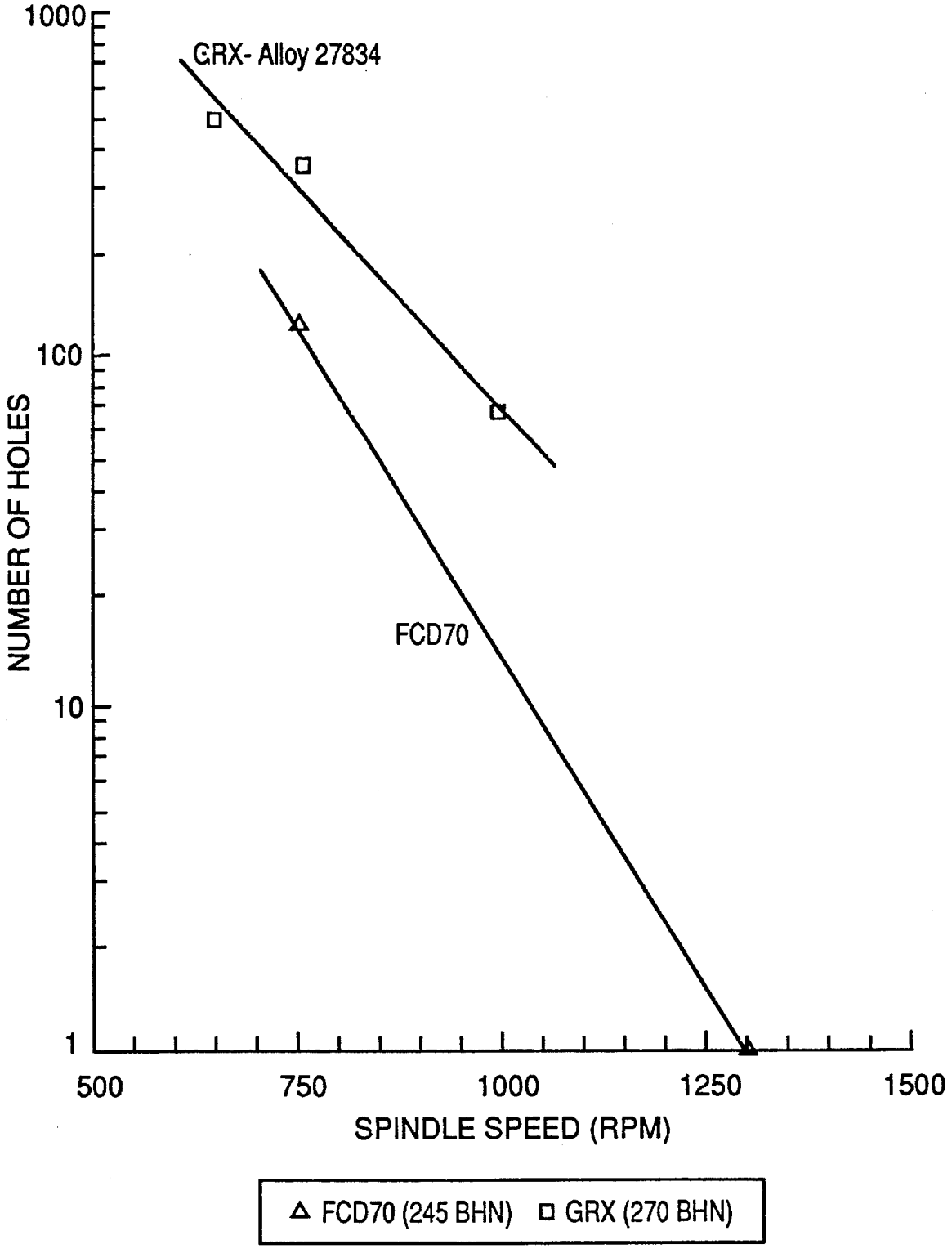
FIG. 10 graphically depicts drilling tests similar to FIG. 9 comparing graphitic Alloy 27834 and ductile cast iron.

Alloy 27834 (Table I) was processed as a bottom-poured production ingot (600 mm square) cast heat which was rolled at 1121° C. to 230mm ×250mm, cooled, and then reheated and rolled at 1121° C. to 4.25" round-cornered square billets. To lower the hardness and achieve the necessary graphitization, the billets were subjected to the thermal cycle described above in EXAMPLE I. The microstructure is shown in FIG. 8 and the resulting hardness is 260 BHN. The resulting matrix carbon content is approximately 0.43. The results from drilling tests, graphically depicted in FIG. 9, indicate enhanced tool life over conventional steels, leaded steels, and bismuth-containing steels. A similar comparison is made with ductile cast iron, shown in FIG. 10, at the indicated hardnesses.

The graphitic Alloy 27834 was also hot pierced successfully on a Mannesmann mill to produce seamless tubing at a piercing temperature of approximately 1100° C. and thermally treated as above to yield a seamless tubular product consisting of ferrite, pearlite and graphite. The tubular product was cut to form slugs which were then machined. Surfaces of machined slugs were induction hardened using commercially available equipment to demonstrate the hardenability of the material and its suitability for use in the manufacture of gear rings.

EXAMPLE IV

Figure 11A:
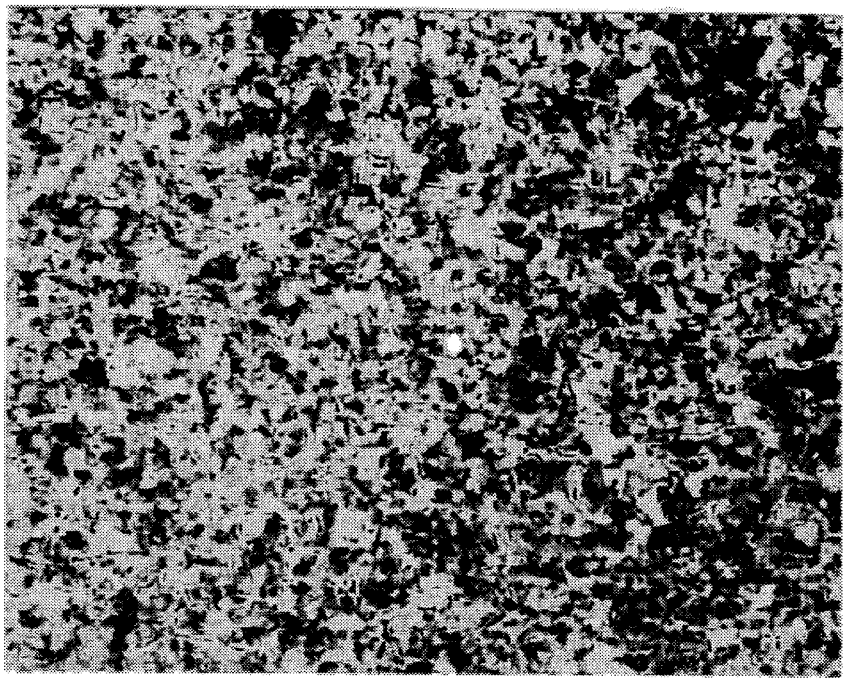
FIG. 11 (*a*) is a photomicrograph of graphitic Alloy 92654 (Table I) at a magnification of 100× power, taken from a forged crankshaft, air cooled at a hardness of 350 BHN.
Figure 11B:
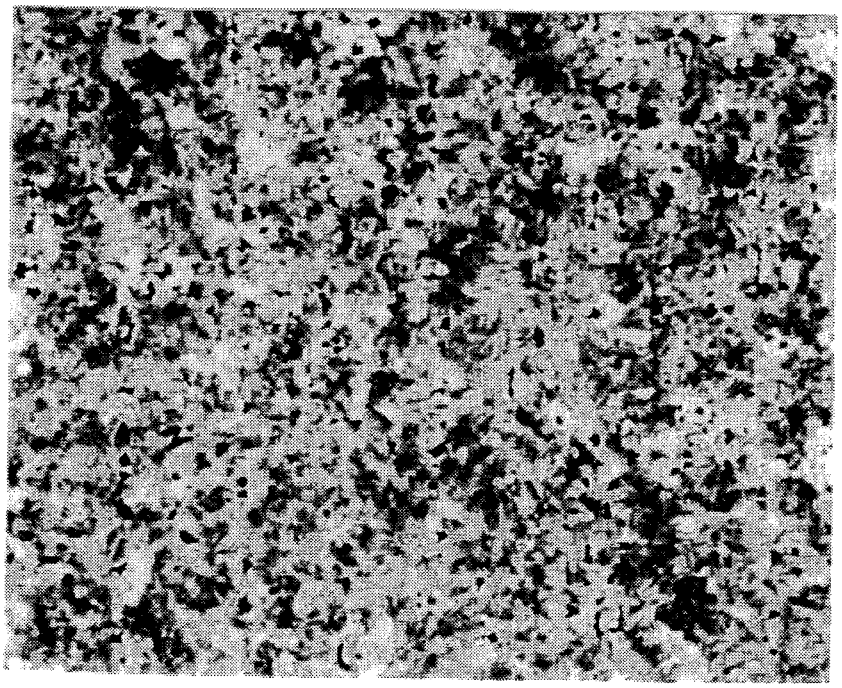

Alloy 92654 (Table I) represents a bottom-poured production ingot (600mm square) cast heat which was processed as in Example 3 into 4.75 inch round cornered square billets for subsequent forging. The billets were forged into crankshafts at 1121° C., with a finishing temperature above 1000° C. Following forging, the crankshafts were air cooled and examined for graphitic carbon. Significant amounts of graphite were present following forging, as can be seen in FIG. 11 (*a*). The forged components can be used in the as-forged condition at a hardness of approximately 350 BHN, or can be heat treated as shown in FIG. 11 (*b*) to tailor the amount and distribution of graphite and the mechanical properties (290 BHN) for various applications. The matrix carbon content is 0.7 weight % for the heat treated crankshaft alloy of FIG. 11(*b*).

In a crankshaft manufacturing operation, the forged and cooled workpiece is finish machined by various conventional turning and drilling operations. Journal portions of the finished crankshaft can be induction hardened to increase wear resistance.

A still more preferred chemistry for graphitic steel alloy of the present invention is as follows:

Total C: 1.15 to 1.3 weight %.

Carbon contents below 1.15% reduce the graphitization potential and limit the amount of graphite that forms on cooling following hot working. Carbon levels above 1.3% reduce the available hot working temperature range, making the steel more sensitive to cracking during hot working. The matrix carbon content is preferably controlled within the range of about 0.2 to 0.8 weight %. A balance of the total carbon falling within the range of 0.35 to 1.1 weight % is in the form of graphite.

Mn: 0.35 to 0.70 weight %.

Manganese is essential in steels to combine with S to form MnS and also to increase hardenability of the steel. Excess Mn reduces graphitization.

Si: 1.50 to 2.0 weight %.

Silicon must be balanced with carbon to achieve the desired graphitization on cooling.

Al: 0.02 to 0.20 weight %.

It is preferred that the steel be aluminum killed and, therefore, contain a minimum of 0.02% Al. Al promotes the formation of spheroidal or nodular graphite. Spheroidal graphite is preferred for enhancing the transverse mechanical properties. Although additional aluminum further promotes graphitization, surface quality of the hot worked components may dictate whether the higher Al levels result in adequate articles.

S: <b 0.06weight %.

Sulfur forms MnS inclusions which improve machinability but can be detrimental to the mechanical properties of the steel. Therefore, sulfur should be kept to the minimum necessary for machinability. In addition, high sulfur levels contribute to an increase in surface cracking problems during some hot working operations such as seamless tube piercing.

Cr, Mo: each <0.1 weight %.

Chromium and molybdenum are strong carbide formers and should be added only to the extent that the desired hardenability is achieved. It is still more preferable that Mo be kept below 0.05 weight % to further enhance solid state graphitization.

Ni: 0.50 weight %.

Nickel enhances graphitization, but should be added primarily to achieve the desired hardenability and properties in the steel.

Thus, it will be readily appreciated that the alloy compositions of the invention can be hot worked into various shapes (billets, bars, seamless tubing, and forged components) and the core properties and matrix carbon content can be controlled by the composition and by the subsequent thermal-mechanical processing. Accordingly, the steel articles so produced achieve the desired microstructures and properties prior to machining and do not require additional heat treatments following machining, although the surface of the steel articles can be induction hardened, if desired. In addition, the graphitic carbon imparts machinability comparable to, and even exceeding, that of steels containing Pb or Bi and also ductile cast iron at similar strength levels.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A highly machinable graphitic steel consisting essentially of in weight % about 1.0 to 1.3 total C; 1.0 to 2.5 Si; 0.3 to 1.0 Mn; up to 2.0 Ni; up to 0.5 Cr; up to 0.5 Mo; up to 0.1 S; up to 0.5 Al; balance Fe and incidental impurities, said steel having a controlled matrix carbon content in the range of about 0.2 to 0.8 weight and wherein a balance of the total carbon content is in the form of graphite in an amount greater than about 0.4 weight %; said steel further having a carbon equivalent "CE" value defined by the formula: CE=% C+⅓ % Si maintained in a range of about 1.75 to 2.1.

2. The graphitic steel of claim 1 having about 0.02 to 0.20 weight % Al and wherein the graphite is in the form of spheroidal graphite.

3. The graphitic steel of claim 1 having about 0.4 to 1.1 weight % carbon in the form of graphite.

4. The graphitic steel of claim 1 further including in weight % up to 0.01 Ca; up to 0.01 of Mg; up to 0.100 of a rare earth metal; and up to 0.0050 B.

5. A highly machinable graphitic steel consisting essentially of in weight % about 1.15 to 1.3 total C; 1.75 to 2.0 Si; 0.35 to 0.70 Mn; less than 0.06 S; 0.02 to 0.20 Al; less than 0.50 Ni; less than 0.1 of Cr; less than 0.1 Mo; balance Fe and incidental impurities, said steel having a controlled matrix carbon content in the range of about 0.2 to 0.8 weight % and wherein a balance of the total carbon content is in the form of graphite in an amount greater than about 0.4 weight %; said steel further having a carbon equivalent "CE"value defined by the formula CE=% C+⅓ % Si maintained in a range of about 1.75 to 2.1.

6. The graphitic steel of claim 5 having up to about 1.1 weight % carbon in the form of graphite.

7. The graphitic steel of claim 5 further including in weight % up to 0.01 of at least one member of the group consisting of Ca and Mg; up to 0.100 of one of a rare earth metal; and up to 0.0050 B.

8. A process for making a graphitic steel article comprising the steps of:

(a) providing a steel alloy having a composition consisting essentially of in weight % about 1.0 to 1.3 total C; 1.0 to 2.5 Si; 0.3 to 1.0 Mn; up to 2.0 Ni; up to 0.5 Cr; up to 0.5 Mo; up to 0.1 S; up to 0.5 Al; balance Fe and incidental impurities;

(b) hot working the steel at a temperature of at least 1000° C. to produce a hot worked shape;

(c) cooling the hot worked shape to develop a microstructure comprising ferrite, pearlite and graphite and having a matrix carbon content of from about 0.2 up to 0.8 weight % C with a balance of the total carbon being in the form of graphite in an amount greater than about 0.4 weight %; and (d) machining said shape to produce a finished article.

9. The process of claim 8 wherein the hot working step includes one or more hot working operations selected from the group consisting of rolling, forging and piercing.

10. The process of claim 8 including the further step of thermally treating the finished article.

11. The process of claim 8 including the further step of thermally treating the hot worked article prior to the machining step (d).

12. The process of claim 8 including the further step of hardening selected areas of the finished article by induction heating.

13. A process for making a graphitic steel article comprising the steps of:

(a) providing a steel alloy having a composition consisting essentially of in weight % about 1.0 to 1.3 total C; 1.0 to 2.5 Si; 0.3 to 1.0 Mn; up to 2.0 Ni; up to 0.5 Cr; up to 0.5 Mo up to 0.1 S; up to 0.5 Al; balance Fe and incidental impurities;

(b) piercing and hot working the steel at a temperature of at least 1000° C. to produce an elongated, seamless tubular shape;

(c) cooling the pierced and hot worked seamless tubular shape to develop a microstructure comprising ferrite, pearlite and graphite and subsequently thermally treating the tubular shape to develop a desired matrix carbon content of between about 0.2 and 0.6 weight % with a balance of the total carbon being in the form of graphite in an amount between about 0.4 to 1.1 weight % and to develop desired physical properties.

14. The process of claim 13 including the further steps of cutting and machining the thermally treated tubular shape to produce ring gears.

15. The process of claim 14 including the further step of induction hardening the ring gears.

16. A graphitic steel consisting essentially of in weight % about 1.0 to 1.3 total C, having a matrix carbon content of about 0.2 to 0.6 with a balance of the C present in the form of graphite in an amount between about 0.4 to 1.1; 1.0 to 2.5 Si; 0.3 to 1.0 Mn; up to 2.0 Ni; up to 0.5 Cr; up to 0.5 Mo; up to 0.1 S; up to 0.5 Al; balance Fe and incidental impurities, said steel having a microstructure comprising ferrite, pearlite and spheroidal graphite and being highly machinable.

17. A graphitic steel article according to claim 21.

18. The steel article of claim 17 in the form of a pierced, seamless tube.

19. The steel article of claim 17 in the form of a ring gear.

20. The steel article of claim 17 in the form of a crankshaft.

21. The steel article of claim 17 which is induction hardened.

22. A highly machinable graphitic steel in a hot worked and cooled condition consisting essentially of in weight % about 1.0 to 1.3 total C; 1.0 to 2.5 Si; 0.3 to 1.0 Mn; up to 2.0 Ni; up to 0.5 Cr; up to 0.5 Mo; up to 0.1 S; up to 0.5 Al; balance Fe and incidental impurities, said steel having a controlled matrix carbon content in the range of about 0.2 to 0.8 weight % and wherein a balance of the total carbon content is in the form of graphite in an amount greater than about 0.4 weight % and having a microstructure consisting of ferrite, pearlite and graphite.

23. A highly machinable graphitic steel in a hot worked and cooled condition consisting essentially of in weight % about 1.15 to 1.3 total C; 1.75 to 2.0 Si; 0.35 to 0.70 Mn; less than 0.06 S; 0.02 to 0.20 Al; less than 0.50 Ni; less than 0.1 of Cr; less than 0.1 Mo; balance Fe and incidental impurities, said steel having a controlled matrix carbon content in the range of about 0.2 to 0.8 weight % and wherein a balance of the total carbon content is in the form of graphite in an amount greater than about 0.4 weight % and having a microstructure consisting of ferrite, pearlite and graphite.

* * * * *

UNITED STATES PATENT AND TRADEMARK OFFICE

CERTIFICATE OF CORRECTION

PATENT NO. : 5,478,523

DATED : December 26, 1995

INVENTOR(S) : James A. Brusso and George T. Matthews

It is certified that error appears in the above-indentified patent and that said Letters Patent is hereby corrected as shown below:

Title page, item [57],

Abstract Line 2 "1.0 to Si;" should read --1.0 to 2.5 Si;--.

Column 3 Line 54 after "Alloy" insert --671--.

Column 3 Line 57 after "Alloy" insert --632--.

Column 4 Line 1 after "Alloy" insert --27834--.

Column 4 Line 29 "(250° C.)" should read --(< 250° C.)--.

Column 4 Line 57 "were" should read --was--.

Table I-continued, Column 7, Alloy 672, under element 'Cr', "0.01" should read --0.10--.

Table I-continued, Column 8, Alloy 855, under element 'N (wppm)', "89" should read --84--.

Column 9 Line 37 "Example 3" should read --Example III--.

Column 10 Line 17 "S: <b 0.06weight %." should read --S: < 0.06 weight %.--.

UNITED STATES PATENT AND TRADEMARK OFFICE

CERTIFICATE OF CORRECTION

PATENT NO. : 5,478,523

DATED : December 26, 1995

INVENTOR(S) : James A. Brusso and George T. Matthews

It is certified that error appears in the above-indentified patent and that said Letters Patent is hereby corrected as shown below:

Column 10 Line 31 "Ni: 0.50 weight %." should read --Ni: < 0.50 weight %.--.

Claim 1 Line 63 Column 10 after "weight" insert --%--.

Claim 13 Line 1 Column 12 "Mo up" should read --Mo; up--.

Signed and Sealed this

Fourth Day of June, 1996

Bruce Lehman

*Attest:*

BRUCE LEHMAN

*Attesting Officer*

*Commissioner of Patents and Trademarks*